United States Patent [19]

Grupp

[11] 4,182,170

[45] Jan. 8, 1980

[54] DEVICE FOR CUTTING A FIBER WEB

[75] Inventor: Hans Grupp, Königsbronn, Fed. Rep. of Germany

[73] Assignee: J. M. Voith GmbH, Fed. Rep. of Germany

[21] Appl. No.: 856,089

[22] Filed: Nov. 30, 1977

[30] Foreign Application Priority Data

Dec. 11, 1976 [DE] Fed. Rep. of Germany ..... 2656242

[51] Int. Cl.[2] ..... B26F 3/00

[52] U.S. Cl. ..... 83/177; 83/53

[58] Field of Search ..... 83/177, 53

[56] References Cited

U.S. PATENT DOCUMENTS

| | | | |
|---|---|---|---|
| 1,878,184 | 9/1932 | Roesen | 83/177 X |
| 3,517,578 | 6/1970 | Krofta | 83/177 X |
| 3,526,162 | 9/1970 | Wilcox | 83/53 X |
| 3,978,748 | 9/1976 | Leslie et al. | 83/177 X |
| 4,007,652 | 2/1977 | Shinomiya et al. | 83/177 X |

*Primary Examiner*—Frank T. Yost

*Attorney, Agent, or Firm*—Ostrolenk, Faber, Gerb & Soffen

[57] ABSTRACT

For cutting a continuous longitudinally moving fiber or paper web, at least one water spraying jet nozzle is arranged to the side of and above one surface of the web and is swiveled so that its jet sprays across the moving web to cut same; two similar jet nozzles at both sides of the web may also be provided.

15 Claims, 7 Drawing Figures

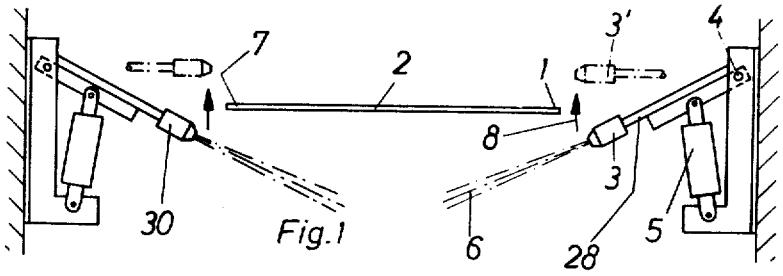
Fig.1
Fig.2
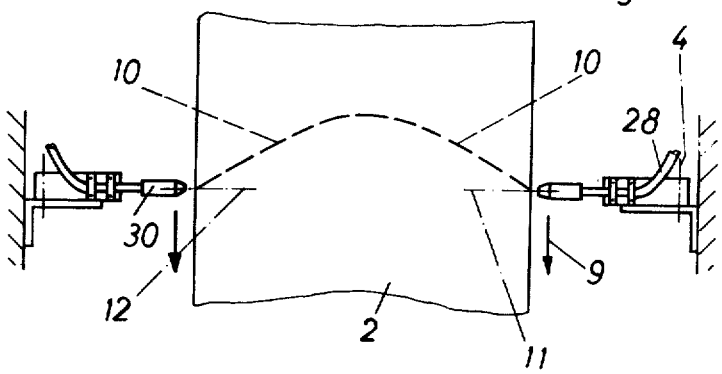
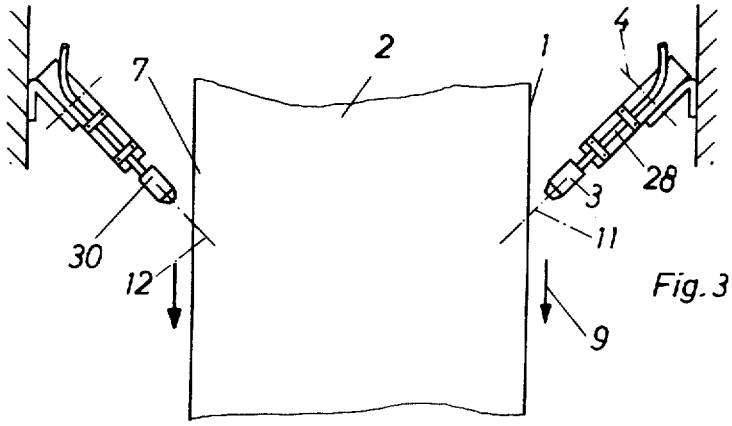
Fig.3

DEVICE FOR CUTTING A FIBER WEB

The invention relates to a device for cutting a fiber web, specifically a paper web, by the spray from at least one water or other liquid jet nozzle. The nozzle moves so that the water or other liquid jet travels across and cuts through the web.

BACKGROUND OF THE INVENTION

In one known device of this type (shown in German Pat. No. 1,293,563) a water jet nozzle having its outlet directed perpendicular to the plane of the web is moved across the web, together with its supply pipe, by means of a roller chain. This device is complicated and prone to breakdown. That is why it is used only to a limited degree in paper cutting machines.

With paper cutting machines, the paper web is "beat loose," i.e., cut, only if the web is torn off somewhere in the machine. In this case the web normally is beat loose on the first free pull, i.e., the part of the path of travel of the web at which it runs for the first time without any support from a filter, a felt layer or a roller. At the beat-loose point, the subsequent length of fiber web that is being fed from the headbox runs into a bin until the machine ends (press ends, dry ends, etc.) are ready again for operation.

Because of the drawbacks of the known water nozzle devices, the paper web normally is beat loose either by an operator, who cuts the web loose by hand, or by an immovably positioned air jet, which is directed from the side of the paper web against the lengthwise edge of the web. Only the lengthwise edge of the paper web is torn off, and the paper web thereafter completes tearing itself apart. But, this is successful only with a thin type of paper web having only a slightly longitudinal fiber direction. With webs having greater longitudinal strength, there is a danger that after the web is cut inwardly only partway across its width, the web will thereafter continue to tear in a longitudinal direction. Another drawback is that the beat loose web end frequently curls up. This produces a multiple web thickness that runs through subsequent pressure slits of the paper cutting machine. The pressure slits are defined between opposed pressure rollers and the slits contain filters or, felt layers, and the thick, multi-layer web can damage them as well as the pressure rollers. The web may shred in the pressure slits, and scraps of the web will have to be removed. This results in extensive down time for the exchanging of filters and, in the case of peripheral groove equipped press rollers, for the cleaning of the grooves.

SUMMARY OF THE INVENTION

The above described problem is solved according to the invention through a device of the initially described type having a simpler design, higher operating safety and wider applicability. The device comprises a jet nozzle which sprays a liquid, like water, and that is swivelably arranged to pivot around a stationary swiveling axis.

No conveyor device is required for moving the entire jet nozzle across the fiber web. Particularly with paper cutting machines for handling quite wide paper webs, e.g., paper web widths up to and exceeding 9 m., the invention is advantageous. Beyond a certain maximum web width, a single swivelable jet nozzle is not enough. Then two or more swivelable jets spaced apart across the width of the web will be used as needed to cover the entire fiber web width.

When the invention is used, the feeder chain and chain wheels required with known devices can be dispensed with. Also, the conventional hose pipe, which interferes with the operations of known devices does not have to be dragged over the entire web width by the jet nozzle.

Accordingly, it is the object of the invention to effectively beat loose a fiber web.

It is another object of the invention to accomplish the foregoing with an effective liquid spray jet nozzle means.

It is a further object of the invention to effect the spraying of liquid from such a spray jet nozzle without any encumbrance arising from transporting the hose that supplies the jet nozzle.

Other objects and features of the invention will be better understood from the following description of the accompanying drawings.

BRIEF DESCRIPTION OF THE DRAWINGS

Several embodiments of the invention are described below in conjunction with the drawings, wherein:

FIG. 1 schematically illustrates one embodiment of the invention;

FIG. 2 is a top view of the embodiment of FIG. 1;

FIG. 3 is a top view, of a similar type of FIG. 2, showing another embodiment of the invention;

DESCRIPTION OF THE PREFERRED EMBODIMENTS

Figure 4:
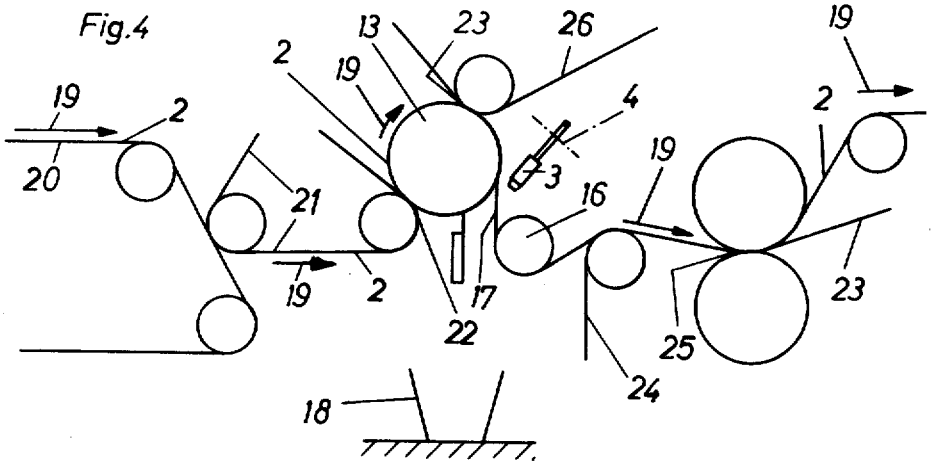
FIG. 4 is a schematized, lateral cross-sectional view of a paper cutting machine equipped with a device according to the invention.

In the first embodiment shown in FIG. 1, a jet nozzle 3 has an outlet that is spaced laterally a short distance from the longitudinal edge 1 of a fiber or paper web 2. The jet nozzle 3 is swivelably supported upon a swiveling axis 4. This axis is held stationary relative to the machine support. A pressure cylinder 5 is connected to the nozzle 3 for controllably swiveling the jet nozzle. Swiveling axis 4 extends parallel to the direction of movement of the fiber web 2. The axis is also arranged outside the fiber web width and outside the fiber web plane. The web plane is the plane of the portion of the web that is then moving past the nozzle 3. As shown in FIG. 1, the swiveling axis 4 lies above the fiber web plane, but it could, of course, alternatively be arranged below this plane.

The result of this placement of nozzle 3 and axis 4 is that the liquid or water jet 6 projected from nozzle 3 travels from the near longitudinal edge 1 of the web 2 across the fiber web 2 to the remote longitudinal edge 7. The jet 6 cuts the fiber web across the fiber web plane when the nozzle 3 is swiveled from its illustrated solid line initial position around swiveling axis 4 in the direction of arrow 8 into its dash-dot-line final position, at which the jet nozzle is designated 3'. A further result of the placement of the nozzle 3 and the axis 4 is that the water jet 6 from nozzle 3 strikes the fiber web near longitudinal edge 1 at a maximum angle to the fiber web plane, where the danger of a curling of the just cut fiber web edge is greatest. This striking angle decreases as the water jet 6 is moved across the fiber web 2. As a result, with the single water jet, a very large fiber web width can be covered, without the cut-loose fiber web end being turned over or curled.

It is important for the invention that the jet nozzle 3 eject a focused and practically unscattered liquid or water jet. The design details of the nozzle are not shown, however, because such jets are well known.

For relatively greater fiber web widths, a jet nozzle 3 of the above described type is arranged at both sides of the fiber web 2. In FIG. 1, such an additional jet nozzle 30 faces the opposite fiber web longitudinal edge 7. Nozzle 30 is the same type as and is supported on a respective supporting axis in the same manner as nozzle 3. Nozzle 30 is, therefore, shown without any associated further details. Jet nozzles 3 and 30 are arranged to face each other and are simutaneously mutually swivelable.

The fiber web 2 moves continuously in the direction of arrow 9 in FIG. 2. Because of the relative motion between the movement of the water jet 6 across the web and of the fiber web 2 along the length of the web, the line of separation and/or intersection 10 between cut sections of the web does not run perpendicular to the web moving direction 9, but instead slants rearward or counter to the direction of web motion. On using two jets 3 and 30, they are placed so that and move so that both lines of separation 10 according to FIG. 2 meet approximately at the center of fiber web 2. Particular separations can be obtained by a timing adjustment of the jet swiveling speed to web speed.

In FIG. 2, the jet nozzles 3 and 30 are arranged so that the theoretical axes 11 and 12 of their outlet orifices run perpendicular to the fiber web moving direction 9. By contrast, in the second embodiment of FIG. 3, the jet nozzles 3 and 30 are arranged so that the theoretical axes 11 and 12 of their outlet orifices define an acute angle with and are generally aimed toward the fiber web moving direction 9 to converge into it. In FIGS. 2 and 3, the supports for the swiveling nozzle give the nozzle outlets their recited directions. The orientation of the nozzle support in FIG. 3 causes the jet nozzle swiveling plane to intersect the fiber web plane at an angle of less than 90° as the planes converge in the moving direction 9 of the web. This has the advantage that warping of fiber web edges 1 and/or 7 is avoided even better than with the perpendicular intersection of these planes according to FIGS. 1 and 2. A slanted alignment of jet nozzle outlet orifice axes 11 and 12 can alternatively be arranged so that contrary to FIG. 3, the jet nozzle swiveling axis 4 intersects with the fiber web moving direction 9 to produce a sharp angle, which converges counter to the moving direction 9.

Figure 5:
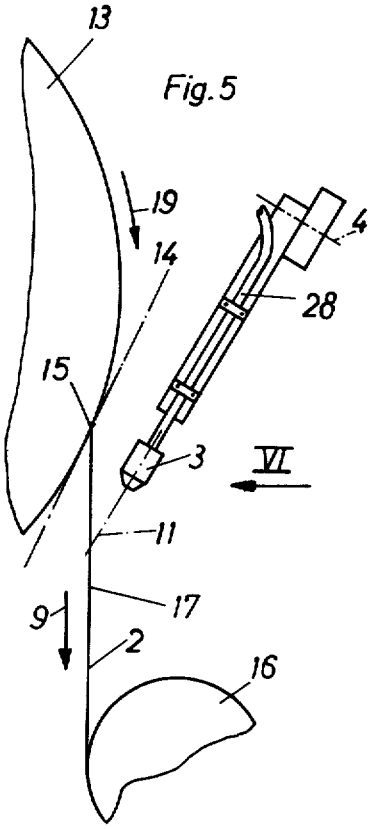
FIG. 5 is an enlarged fragmentary view of the machine shown in FIG. 4.
Figure 6:
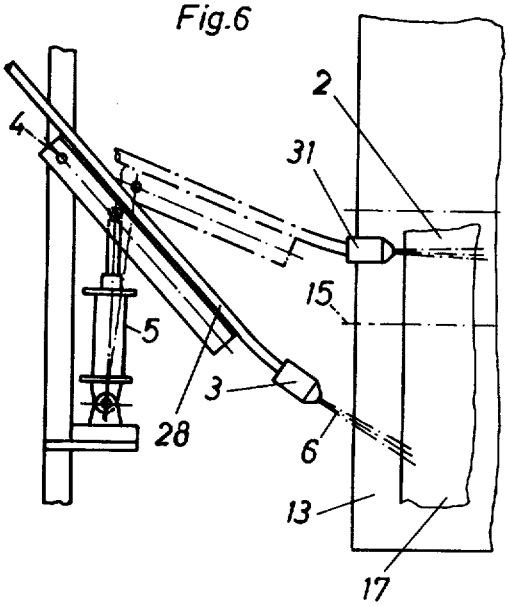
FIG. 6 is a schematic view in the direction of arrow VI in FIG. 5.

In FIGS. 4–6, elements identical with those in FIGS. 1–3 are identically numbered. The jet nozzle 3 is arranged in a paper machine near a press roller 13. The theoretical axis 11 of the jet nozzle outlet orifice and also the jet nozzle swiveling plane substantially run parallel with a tangent 14 on the outer periphery of roller 13 at point 15 around the periphery, at which point the fiber web 2 runs off roller 13. A roller like roller 13 frequently is a stone roller. The section between stone roller 13 and downstream deflection roller 16 represents the first free pull unsupported area 17 along fiber web 2. Up to this free pull area, the web was always supported by a filter, a felt layer or a roller. This first free pull area 17 includes the point at which the fiber web is usually beat loose and/or cut if breakdown occurs in the fiber web production run. If fiber web 2 is beat loose by the liquid or water jet 6 of nozzle 3, then the paper following the cut section falls into a container 18.

Fiber web 2 runs through the paper machine along the path indicated by arrows 19 in FIGS. 4 and 5. In this case, the web is passed from a machine wire web 20, to which the fiber suspension is applied via a material headbox (not shown), to a supporting felt layer 21. The web is pressed twice against stone roller 13, once through pressing slit 22 defined between roller 13 and a pressing roller while the web 2 is in engagement with felt layer 21, and once again through pressing slit 23 defined between roller 13 and another pressing roller. The web is passed through the latter slit 23 along with a supporting felt layer 26. The fiber web now passes unsupported through free pull section 17 and around deflecting roller 16. Then, together with felt layer 24, the web is passed through a further pressing slit 25 defined between to further rollers.

Figure 7:
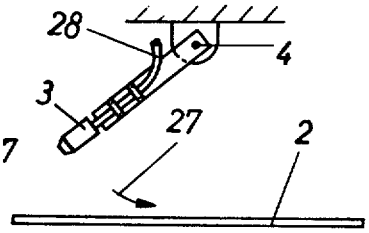
FIG. 7 is a schematic view of another embodiment of the invention viewed along the fiber web moving direction.

With the third embodiment according to the invention shown in FIG. 7, the swiveling axis 4 and also the jet nozzle 3 are not arranged adjacent to the fiber web 2, but they are preferably above (or perhaps below) it, and jet nozzle 3 is swivelable along the pathway indicated by arrow 27.

In all embodiments, water or other liquid is fed to jet nozzles 3 and 30 by respective lines 28. In jet nozzles 3 and 30 and/or in their feed-in lines 28, there is a shut-off valve (not shown). To supply liquid or water, the valve is automatically opened and jet nozzles 3 and/or 30 are swiveled by a well known (not shown) web tear-off control device each time the fiber web inside the paper machine is to be torn off.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A device for cutting a web of fiber, paper or the like, comprising:

means for moving the web longitudinally;

a jet nozzle for spraying liquid on the web as the web is moving longitudinally and relatively to said jet nozzle; said jet nozzle including an outlet supported above the plane of the web, the plane of the web being the plane through which the web is moving at the location along the length of the web at which the liquid is to be sprayed;

a stationary support axis for supporting said jet nozzle with said outlet above the plane of the web as the web moves relatively to said jet nozzle;

said jet nozzle being swivelably mounted to said support axis for enabling swiveling of said jet nozzle in a jet nozzle swivel plane such that the spray of liquid traverses across the web and cuts the plane of the web during swiveling of said jet nozzle; means for swiveling said jet nozzle around its said support axis in said jet nozzle swivel plane as the web is moving longitudinally and relatively to said jet nozzle; said jet nozzle swivel plane intersecting the plane of the web.

2. The device for cutting a web of claim 1, wherein said jet nozzle swivel plane intersects the plane of the web at an angle of less than 90°.

3. The device for cutting a web of claim 2, wherein the jet nozzle is oriented to direct its spray downstream in the moving direction of the web.

4. The device for cutting a web of claim 1, wherein the web has a width between its side edges and said jet nozzle is supported within the width of the web.

5. The device for cutting a web of claim 1, wherein the web has a width between its side edges and said jet nozzle is supported laterally outside the width of the web.

6. The device for cutting a web of claim 1, further comprising web moving means for moving a web lengthwise in a moving direction and for moving the web lengthwise in the moving direction along the plane of the web; said web moving means including a roller off which the web is fed as the web moves into the plane of the web; said roller including a point around its surface to which the web is tangent as it leaves said roller;

said jet nozzle being swivelable around said support axis through said jet nozzle swivel plane; said jet nozzle swivel plane being substantially parallel to a line across said roller at said point on said roller surface.

7. The device for cutting a web of claim 1, further comprising a second said jet nozzle and a respective second said stationary support axis therefor; said support axes being spaced apart, whereby each said jet nozzle swivels in a respective said jet nozzle swivel plane and each said jet nozzle swivel plane intersects the plane of the web to spray a respective section of the web in the web plane.

8. The device for cutting a web of claim 7, wherein the web has a width between its side edges; each said jet nozzle being supported laterally outside the width of the web beyond a respective side edge of the web.

9. The device for cutting a web of claim 7, wherein said swivel axes are so placed and said jet nozzles are so oriented that at a respective end of each swiveling path of each said jet nozzle, the sprays from each said jet nozzle cross each other in the web plane.

10. The device for cutting a web of claim 9, wherein both said jet nozzles are supported above the same side of the plane of the web.

11. A device for cutting a web of fiber, paper or the like, comprising:

a jet nozzle for spraying liquid on the web, and including an outlet supported above the plane of the web, the plane of the web being the plane through which the web is moving at the location along the length of the web at which the liquid is to be sprayed;

a stationary support axis for supporting said jet nozzle at the aforesaid location;

said jet nozzle being swivelably mounted to said support axis for enabling swiveling of said jet nozzle such that the spray of liquid traverses across the web and cuts the plane of the web; said jet nozzle being swivelable around said support axis through a jet nozzle swivel plane; said jet nozzle swivel plane intersecting the plane of the web at an angle of less than 90°.

12. The device for cutting a web of claim 11, wherein the jet nozzle is oriented to direct its spray downstream in the moving direction of the web.

13. A device for cutting a web of fiber, paper or the like, comprising:

a jet nozzle for spraying liquid on the web, and including an outlet supported above the plane of the web, the plane of the web being the plane through which the web is moving at the location along the length of the web at which the liquid is to be sprayed;

a stationary support axis for supporting said jet nozzle at the aforesaid location;

said jet nozzle being swivelably mounted to said support axis for enabling swiveling of said jet nozzle such that the spray of liquid traverses across the web and cuts the plane of the web;

a second said jet nozzle and a respective second said stationary support axis therefor; said support axes being spaced apart, whereby each said jet nozzle swivels to spray a respective section of the web in the web plane;

said swivel axes being so placed and said jet nozzles being so oriented that at a respective end of each swiveling path of each said jet nozzle, the sprays from each said jet nozzle cross each other in the web plane.

14. The device for cutting a web of claim 13, wherein both said jet nozzles are supported above the same side of the plane of the web.

15. A device for cutting a web of fiber, paper or the like, comprising:

a first jet nozzle for spraying liquid on the web, and including an outlet supported above the plane of the web, the plane of the web being the plane through which the web is moving at the location along the length of the web at which the liquid is to be sprayed;

a first stationary support axis for supporting said first jet nozzle at the aforesaid location;

said jet nozzle being swivelably mounted to said first support axis for enabling swiveling of said jet nozzle in a first jet nozzle swivel plane, which intersects the plane of the web such that the spray of liquid traverses across the web and cuts the plane of the web;

a second said jet nozzle and a respective second said stationary support axis therefor to which said second jet nozzle is swivelably mounted for enabling swiveling of said second jet nozzle in a second jet nozzle swivel place, which also intersects the plane of the web; said first and second support axes being spaced apart, whereby each said jet nozzle swivels to spray a respective section of the web in the web plane;

the web having a width between its side edges; each said jet nozzle being supported laterally outside the width of the web beyond a respective side edge of the web.

* * * * *